US005876243A

United States Patent [19]

Sangawa

[11] Patent Number: 5,876,243

[45] Date of Patent: Mar. 2, 1999

[54] CONNECTOR-EQUIPPED SWITCH BOX

[75] Inventor: Shuhei Sangawa, Sayama, Japan

[73] Assignee: Honda Giken Kogyo Kabushiki Kaisha, Tokyo, Japan

[21] Appl. No.: 864,186

[22] Filed: May 28, 1997

[51] Int. Cl.[6] ..... H01R 13/52

[52] U.S. Cl. ..... 439/519; 439/76.1; 439/206; 200/51 R

[58] Field of Search ..... 200/51 R; 439/206, 439/521, 519, 620, 76.1

[56] References Cited

U.S. PATENT DOCUMENTS 5,310,364 5/1994 Hooper et al. ..... 439/206 X
5,549,487 8/1996 Nortier ..... 439/521

FOREIGN PATENT DOCUMENTS

HEI 5-6605 1/1993 Japan .

*Primary Examiner*—Khiem Nguyen
*Attorney, Agent, or Firm*—Merchant, Gould, Smith, Edell, Welter & Schmidt, P.A.

[57] ABSTRACT

A switch box having a connector comprises eaves for covering an upper part of the connector, side water stopping walls for covering both sides of the connector, and an upper water stopping wall rising from a frontal edge of the eaves. When water splashes on the box from above, the water is guided to the side water stopping walls by the upper water stopping wall, whereafter the water flows down along the side water stopping walls. As a result, water flow to the connector can be prevented.

3 Claims, 7 Drawing Sheets

CONNECTOR-EQUIPPED SWITCH BOX

BACKGROUND OF THE INVENTION

1. Field of the Invention

The present invention relates generally to a connector-equipped switch box and, in particular, to a connector-equipped switch box in which a waterproofing structure is provided for preventing water entered from a switch knob or a box connection from flowing to the connector.

2. Description of the Related Art

A connector-equipped switch box is known from, for example, in Japanese Utility Model Laid-Open Publication No. HEI 5-6605. The general arrangement of the switch box is shown in FIG. 7 hereof.

As shown in this figure, switch box 100 is comprised of a housing 101, an operation knob 102 positioned upon the housing 101 and a connector 103 positioned alongside the housing 101. The housing 101 has a partition wall 104 for separating the operation knob 102 and connector 103. Between the partition wall 104 and operation knob 102, there is provided a groove 105. Formed on a side wall 101*a* of the housing 101 is a through hole 105*a* communicating with outside via the groove 105 for externally discharging water.

In the switch box thus arranged, water entered through a gap between the housing 101 and operation knob 102 is blocked or stopped by the partition wall 104 and externally discharged from the groove 105 via the through hole 105*a*. Thus, there is no concern over water flowing to the connector 103.

Generally, the housing 101 is mounted via a flange 106 thereof to a panel 107 shown by an imaginary line.

However, in the switch device 100 having the through hole 105*a* formed in the side wall 101*a* thereof, when the housing 101 is mounted in an inclined fashion so that the through hole 105*a* is positioned upwardly of the connector 103, water externally discharged via the through hole 105*a* may flow along the outer wall surface of the housing 101 to the connector 103. Thus, there is a limit in the degree of freedom of selecting the mounting position of the housing 101 or the position of provision of the through hole 105*a*.

SUMMARY OF THE INVENTION

It is therefore an object of the present invention to provide a switch box in which water entered from around a switch knob or a box mounting portion is prevented from flowing to a connector thereof.

According to a first aspect of the present invention, there is provided a connector-equipped switch box having at least one switch knob provided on an upper surface thereof, and a connector provided at a side thereof, wherein the switch box further comprises: eaves for covering an upper part of the connector; side water stopping walls for covering both sides of the connector; and an upper water stopping wall rising from a frontal edge of the eaves, whereby water splashed on the box from above flows to the eaves and is then guided to the side water stopping walls so that the water flow to the connector can be prevented.

In the switch box thus arranged, when water splashed on the box from above, the water is guided to the side water stopping walls by the upper water stopping wall. Then, the water flows down along the side water stopping walls. The water thus flows away from the connector. Consequently, water entered from around the switch knob and a connection of the box can be prevented from flowing to the connector.

Preferably, the side water stopping walls have water guides at lower ends thereof for keeping the downwardly flowing water away from the connector. As a result, the water is guided to the water guides and flows away from the connector. Thus, the water flow to the connector can be prevented more effectively.

According to a second aspect of the present invention, there is provided a connector-equipped switch box having at least one switch knob provided on an upper surface thereof, and a connector provided at a side thereof, wherein the switch box further comprises: a water drainage portion for draining water flowing along the switch knob out from the switch box; a water stopping wall for isolating the connector from the water drainage portion; and water guides provided at lower ends of the water stopping wall for keeping water-drops away from the connector.

In the connector-equipped switch box thus arranged, when water splashed on the box from above, the water flows along the switch knob to an upper part of the box and then out from the box through the water drainage portion. The water flown out from the box further flows down along the water stopping wall and is then guided to the water guides, whereafter it flows away from the connector. It thus becomes possible to prevent water from flowing to the connector.

Additional objects, advantages and features of the present invention will become apparent from the following description and appended claims, taken in conjunction with the accompanying drawings.

BRIEF DESCRIPTION OF THE DRAWINGS

Preferred embodiments of the present invention will be explained hereinbelow with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
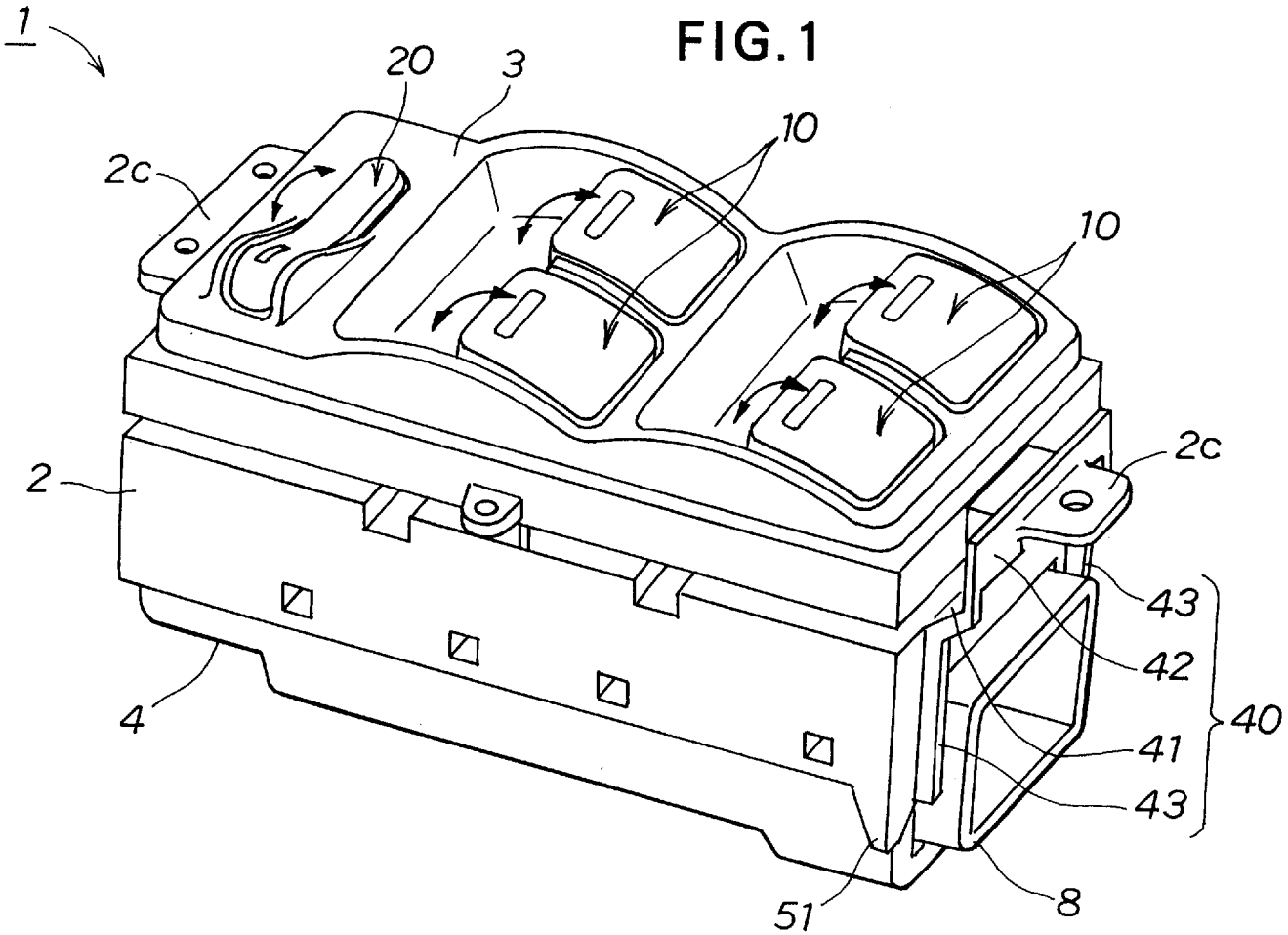
FIG. 1 is a perspective view showing a connector-equipped switch according to a first embodiment of the present invention.

Referring initially to FIG. 1, a connector-equipped switch 1 according to a first embodiment of the present invention is comprised of an elongate box 2, an upper cover 3 and a lower cover 4 laid to sandwich the elongate box 2 therebetween, a connector 8 disposed at a side of the switch 1, four key switches 10 each in the form of a piano key, and a toggle switch 20 in the form of a rocker lever.

The key switches 10 are arranged in two rows longitudinally of the elongate box 2 and have one ends pivotally movable in a vertical direction as shown by respective arrows. The toggle switch 20 is disposed at one end of the box 2 such that it can turn in a transverse direction relative to the box 2.

Figure 2:
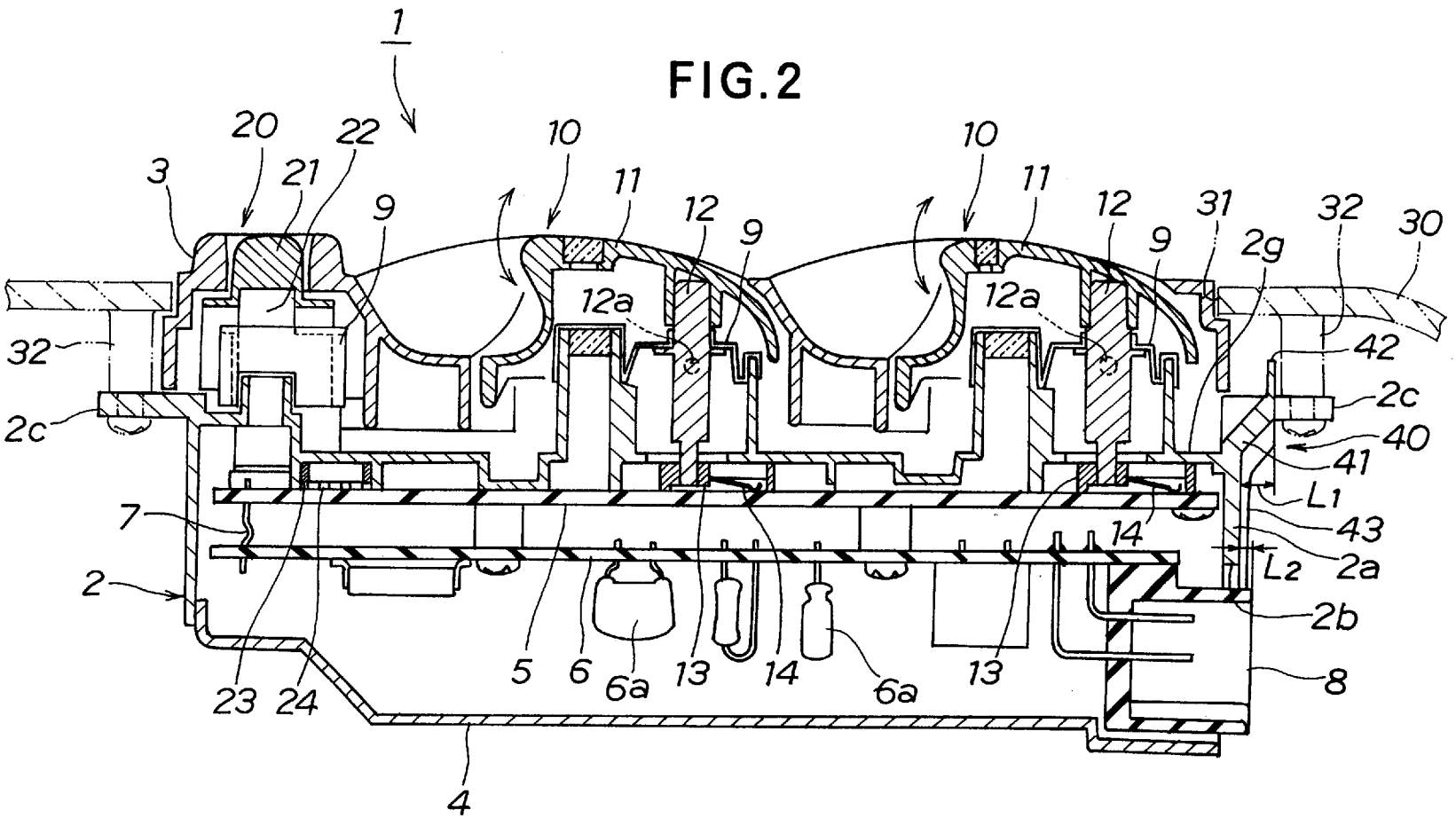
FIG. 2 is a cross-sectional view of the connector-equipped switch shown in FIG. 1.

Turning to FIG. 2, the box 2 has an upper first substrate 5 lying horizontally and a lower second substrate 6 lying parallel to the first substrate 5 in spaced relation to the latter. The box 2 is connected to a panel 30 by means of a screw.

The first substrate 5 is a board having a switching circuit with a stationary contact pattern (not shown) formed thereon. The second substrate 6 is a board having a control circuit with various electronic parts such as one designated by reference numeral 6*a*. The first substrate 5 and second substrate 6 are electrically connected through a flexible cable 7. The second substrate 6 has the connector 8 at one end thereof, which has an end projecting from an open window 2*b* formed in a side wall 2*a* of the box 2.

Each key switch 10 has a key switch knob 11 formed on an upper part of the box 2, a pivot member 12 disposed below the key switch knob 11, a slider 13 mounted to a lower part of the pivot member 12, and a slidable contact strip 14 mounted to the slider 13.

One end of the key switch knob 11 is pivotable about a pin 12*a* disposed at a substantially central part of the pivot member 12.

Upper part of the pivot member 12 is received in a lower part of the key switch knob 11. The pivot member 12 is pivotable about the pin 12*a*. That is, downward pressing of one end of the key switch knob 11 causes the upper part of the pivot member 12 to turn about the pin 12*a* in a leftward direction and the lower part of the pivot member 12 to turn about the pin 12*a* in a rightward direction.

Each slider 13 is caused to horizontally slide on a surface of the first substrate 5 by turning of the pivot member 12 about the pin 12*a*.

The slidable contact strip 14 is caused by the horizontal sliding of the slider 13 to slide on the surface of the first substrate 5 to thereby effect the switching of the stationary contact pattern provided on the upper surface of the first substrate 5.

The toggle switch 20 is comprised of a toggle switch knob 21 mounted to the upper part of the box 2, a pivot member 22 being in fitted engagement with a lower part of the toggle switch knob 21, a slider 23 mounted to a lower part of the pivot member 22, and a slidable contact strip 24 mounted to the slider 23.

By the vertical pivotal movement of the pivot member 22, the slider 23 slides on the surface of the first substrate 5 in a front-and-rear direction relative to the figure.

Sliding of the slider 23 in the front-and-rear direction causes the slidable contact strip 24 to slide on the first substrate 5 to thereby effect the switching of the stationary contact pattern formed on the upper surface of the first substrate 5.

The upper cover 3 is arranged to allow the key switch knobs 11 and toggle switch knob 21 to be exposed to outside and thus serves as an ornamental cover.

The lower cover 4 closes a lower opening of the box 2 and covers the lower part of the connector 8.

Reference numeral 9 designates waterproofing caps each made from a resilient material such as rubber. The waterproofing caps 9 cover openings resulted from positioning the key switches 10 or toggle switch 20 at the upper part of the box 2.

The switch 1 is connected to the panel 30 such that an upper part of the upper cover 3 extends slightly beyond an opening 31 of the panel 30. More specifically, the box 2 has brackets 2*c*, 2*c* provided at an upper part of longitudinal ends thereof, which are connected to leg portions 32 of the panel 30 via screws not shown. The box 2 also has a waterproof cover 40 explained below and formed in the side wall 2*a* having the connector 8 formed therein.

Figure 3:
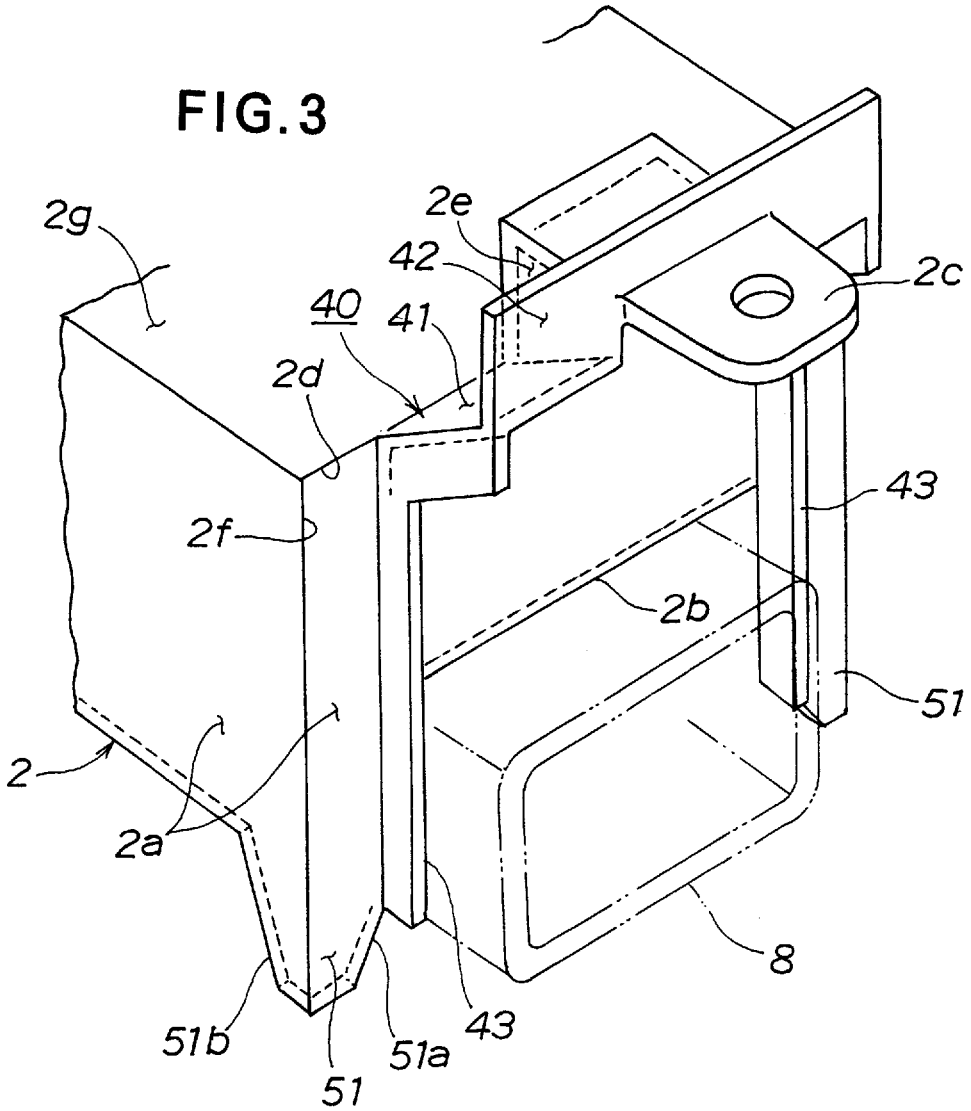
FIG. 3 is a partial perspective view of a switch box of the connector-equipped switch shown in FIG. 1.

Reference is now had to FIG. 3 in which the waterproof cover 40 is shown in detail. The waterproof cover 40 is comprised of eaves 41 covering an upper part of the connector 8, an upper water stopping wall 42 extending upwardly from a frontal edge of the eaves 41, and side water stopping walls 43, 43 covering both sides of the connector 8.

The eaves 41 comprise an inclined plate of predetermined width extending obliquely upwardly from an upper corner 2*d* of the box 2.

The upper water stopping wall 42 comprises a vertical plate rising from a frontal edge of the eaves 41. The vertical plate has a width equal to the width of the eaves 41 and extends across the bracket 2*c* and is formed integrally therewith. The bracket 2*c* of L-shaped section has a blind plate 2*e* for shading both sides thereof.

Each side water stopping wall 43 comprises a plate member suspended downwardly from the lower surface of the eaves 41 along the side wall 2*a* of the box 2. The suspended plate 43 extends beyond the lower surface of the box 2.

The box 2 has two water guides 51, 51 formed integrally with the lower end of the side water stopping wall 43 for keeping water flowing down from the upper part of the box 2 away from the connector 8. More specifically, each water guide 51 comprises a member of L-shaped section suspended from a side corner 2*f* of the box 2. The suspended member 51 has a configuration tapered downwardly. Thus, an edge 51*a* of the water guide 51 is inclined in a direction to go away from the connector 8.

Returning to FIG. 2, the length of extension L1 of the eaves 41 from the outer surface of the box 2 to the outer surface of the eaves 41 is longer than the length of extension L2 of the connector 8.

Operation of the connector-equipped switch 1 thus arranged will now be discussed having reference to FIG. 2.

As can be appreciated from FIG. 2, in each key switch 10, the key switch knob 11 is operated to pivot in a vertical direction. This causes the the pivot member 12 to pivot or turn in a lateral direction about the pivot pin 12*a* to thereby slide the slider 13 in a lateral direction. As a result, the slidable contact strip 14 effects the switching of the stationary contact pattern.

In the toggle switch 20, the toggle switch knob 21 is operated to cause the pivot member 22 to pivot to thereby slide the slider 23 in a front-and-rear direction of the figure being referenced. As a result, the slidable contact strip 24 moves to effect the switching of the stationary contact pattern.

Next, operation of the connector-equipped switch box 2 will be discussed having reference to FIG. 4A and FIG. 4B.

Figure 4A:
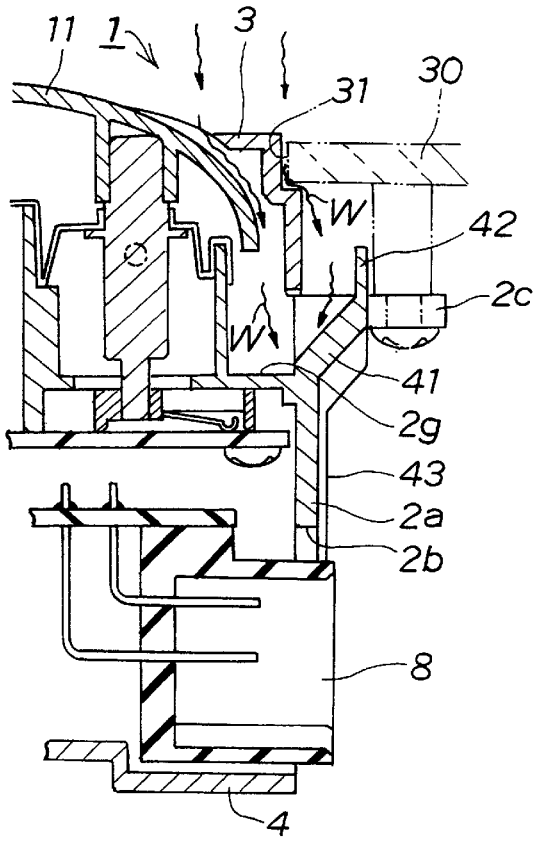
FIG. 4A is a partial cross-sectional view showing the connector-equipped switch in conjunction with the mode of flow of water entered the switch.

As can be appreciated from FIG. 4A, when water is splashed on the connector-equipped switch 1 from above, waterdrops W entered through a gap between the upper cover 3 and key switch knob 11 and through a gap between the upper cover 3 and panel 30 flow down onto an upper surface 2*g* of the box 2 and the eaves 41. The waterdrops W reaching the eaves 41 are guided by the upper water stopping wall 42 to the side water stopping walls 43.

Figure 4B:
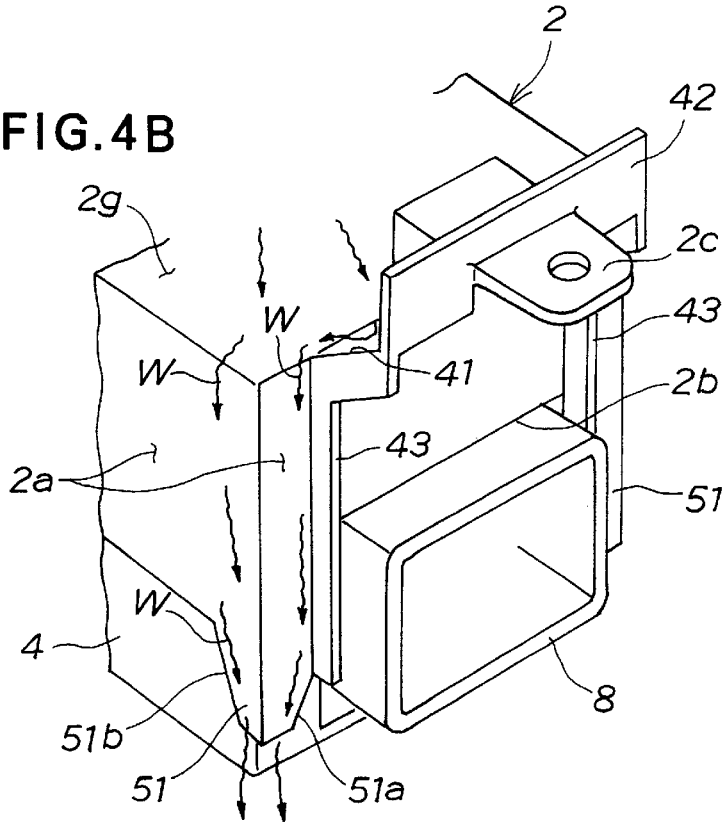
FIG. 4B is a perspective view showing how the entered water flows down along the switch box.

The waterdrops W guided to the side water stopping walls 43 flow therealong, as shown in FIG. 4B. Therefore, the waterdrops W do not flowing to the connector 8. The waterdrops W flown along the side water stopping walls 43 further flow down along the edge 51*a* of the water guide 51 and then drop from a lower end of the water guide 51. In this manner, the waterdrops W are guided to the water guide 51 and flow away from the connector 8. It thus becomes possible to prevent the waterdrops W from flowing onto the connector 8.

The waterdrops W flowing from the upper surface 2*g* of the box 2 down along the side wall 2*a* flow further down along an edge 51*b* of the guide 51 and then drop from the lower end of the water guide 51.

Figure 5:
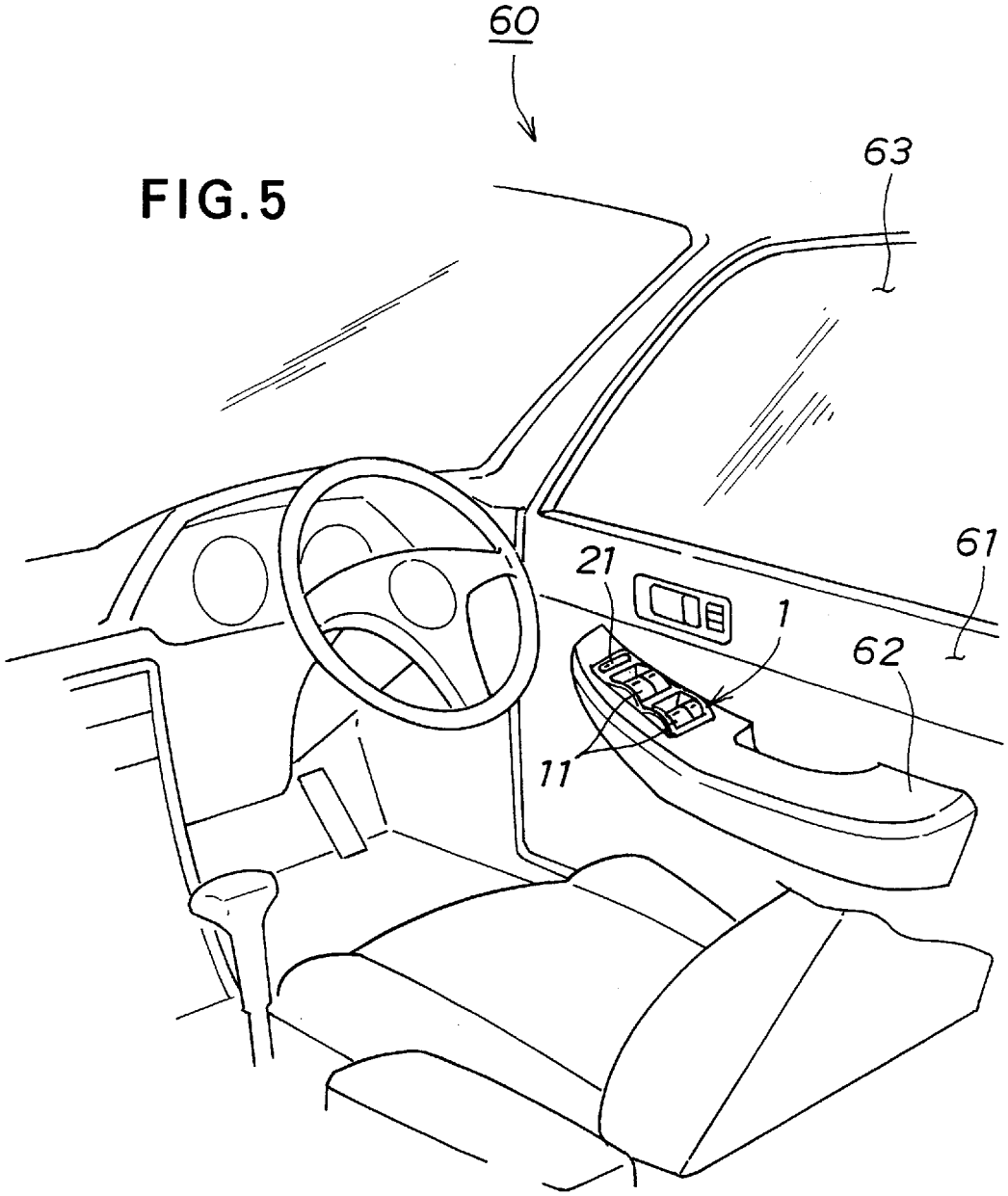
FIG. 5 is a schematic view showing the connector-equipped switch as utilized for a power window of an automobile.

Next, an example application of the connector-equipped switch 1 according to the first embodiment will be discussed with reference to FIG. 5.

The connector-equipped switch 1 may be used as, for example, a switch for a power window of an automobile.

A driver door 61 of an automobile 60 has an armrest 62 which has on its upper part the connector-equipped switch 1 according to the first embodiment. By pivotally moving the four key switch knobs 11, respective window glasses including one designated by reference numeral 63 can be opened and closed through associated motors independently. All the window glasses can be opened and closed simultaneously by pivotally moving the toggle switch knob 21.

Water may splash on the connector-equipped switch 1 if it rains, or the automobile is washed, as the door 61 or the window 63 is kept open. However, the splashed water does not flow to the connector (see FIG. 4B).

Figure 6:
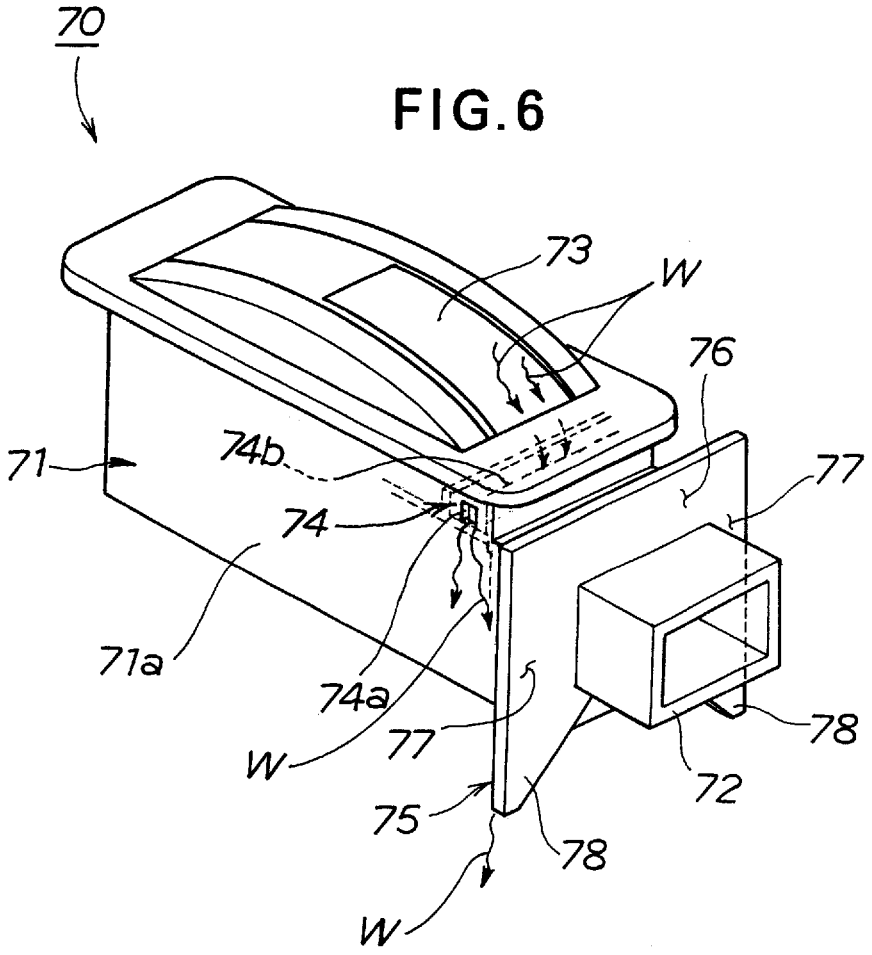
FIG. 6 is a perspective view illustrating a connector-equipped switch according to a second embodiment of the present invention.
Figure 7:
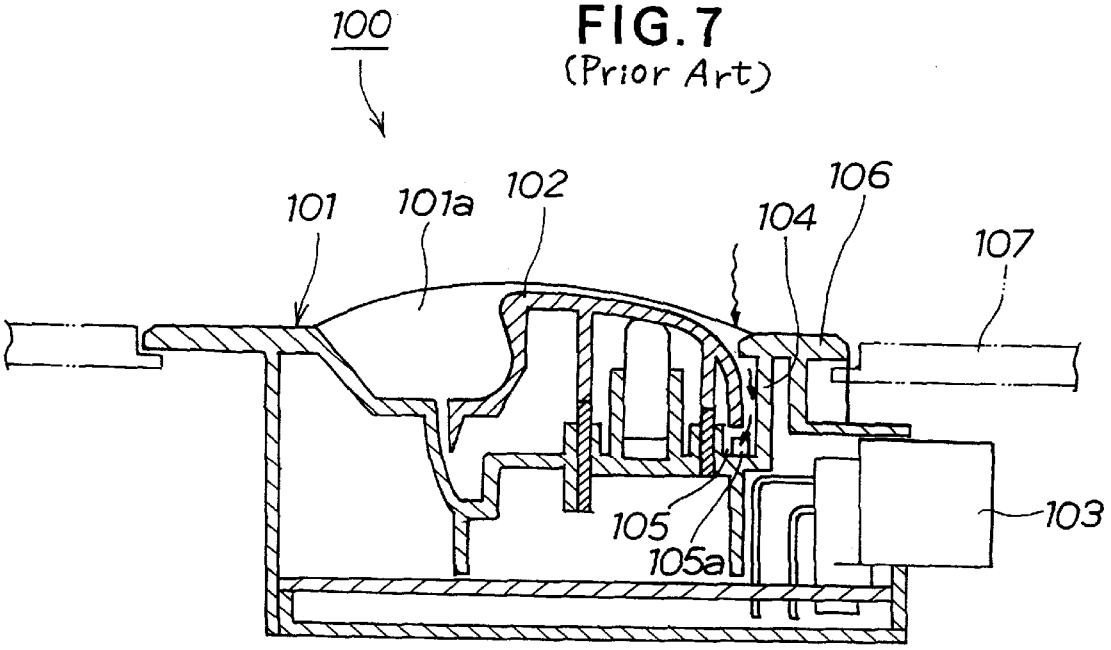
FIG. 7 (Prior Art)
FIG. 7 is a cross-sectional view showing an integral part of a conventional connector-equipped switch.

Reference is now made to FIG. 6 showing a connector-equipped switch 70 according to a second embodiment.

The connector-equipped switch 70 is comprised of a box 71 housing a toggle switch (not shown), a connector 72 provided at a side of the box 71, and a switch knob 73 provided at an upper part of the box 71 for operating the toggle switch.

The box 71 has a water drainage portion 74 for draining water W flowing along the switch knob 73 out from the box 71, and a water stopping wall 75 in the form of a plate for isolating the connector 72 from the water drainage portion 74. At a lower end of the water stopping wall 75, there are provided water guides portions 78, 78 for keeping the downwardly flowing water W away from the connector 72.

The water stopping wall 75 has an upper water stopping wall 76 for covering an upper part of the connector 72, and two side water stopping walls 77, 77 formed integrally with the upper water stopping wall 76 for covering both sides of the connector 72. The water stopping wall 75 also has the water guides 78, 78 provided at lower ends of the side water stopping walls 77, 77.

The water drainage portion 74 is composed of hole 74*a* passing through an outer wall 71*a* of the box 71, and a groove 74*b* formed on an upper surface of the box 71 and communicating with the hole 74*a*. The groove 74*b* is provided to lie normal to the connector 72.

Operation of the connector-equipped switch 70 according to the second embodiment will be described next having reference to FIG. 6.

When water splashed on the box 71 from above, the water W flows along the switch knob 73 down to the upper part of the box 71, where it flows out through the water drainage portion 74. Then, the water W flows down along the water stopping wall 75 isolating the water drainage portion 74 and the connector 72. Thereafter, the water W is guided to the water guides 78, where it drops in a direction away from the connector 72. Water flow to the connector 72 can thus be prevented.

Although the connector-equipped switches 1, 70 have been described as ones for a power window of an automobile, they should not be limited to such an application. The switches may also be applied to any other devices which are disposed at such locations where water may splash on the boxes 2, 71 thereof.

It should also be noted that connector-equipped switches 1, 70 are not limited to the arrangement in which a plurality of switch knobs are provided and that the switches may be of other types than those described above.

It should additionally noted that it is sufficient as long as the waterproof cover 40 composed of the eaves 41, upper water stopping wall 42 and side water stopping walls 43, and the water guides 51 are provided on the box 2. They may be integral with, or bonded to, the box 2. Otherwise, they may also be screwconnected to the box 2 by means of a packing.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A connector-equipped switch box having at least one switch knob provided on an upper surface thereof, and a connector provided at a side thereof, wherein said switch box further comprises:

a partition wall for preventing water entered from around said switch knob and a connection of said box and splashed on said upper surface of said switch box from flowing to said connector, said partition wall being designed to guide the water to flow out of said box; and water guide means for guiding the entered water to drop in a direction away from said connector, said water guide means comprising a suspended member formed integrally with said box and projecting downwardly from a lower end surface of said box.

2. A connector-equipped switch box according to claim 1, wherein said partition wall includes:

eaves for covering an upper part of said connector;

side water stopping walls for covering both sides of said connector; and an upper water stopping wall rising from a frontal edge of said eaves, whereby water splashed on said box from above flows to said eaves and is then guided to said side water stopping walls so that the water flow to said connector can be prevented.

3. A connector-equipped switch box having at least one switch knob provided on an upper surface thereof, and a connector provided at a side thereof, said switch box having an outer wall, wherein said switch box further comprises:

a water drainage portion having a groove and a hole passing through the outer wall of said switch box; and a partition wall for preventing water entered from around said switch knob and a connection of said box and splashed on said upper surface of said switch box flowing from said water drainage portion to said connector, said partition wall being designed to guide the water away from said connector and including water guides formed integrally at a lower end thereof.

* * * * *